US010501900B2

(12) United States Patent
Johnson et al.

(10) Patent No.: US 10,501,900 B2
(45) Date of Patent: Dec. 10, 2019

(54) PORTABLE SIGN FOR A TRAFFIC CONTROL DEVICE

(71) Applicant: Halo Covers, LLC, Windsor, CO (US)

(72) Inventors: Richard F. Johnson, Fort Collins, CO (US); Bradley R. Smith, Timnath, CO (US)

(73) Assignee: Halo Covers, LLC, Windsor, CO (US)

( * ) Notice: Subject to any disclaimer, the term of this patent is extended or adjusted under 35 U.S.C. 154(b) by 0 days.

(21) Appl. No.: 15/428,028

(22) Filed: Feb. 8, 2017

(65) Prior Publication Data

US 2017/0236457 A1 Aug. 17, 2017

Related U.S. Application Data

(60) Provisional application No. 62/294,053, filed on Feb. 11, 2016.

(51) Int. Cl.

| | |
|---|---|
| ***G09F 7/18*** | (2006.01) |
| ***E01F 9/654*** | (2016.01) |
| ***E01F 9/688*** | (2016.01) |
| ***G09F 7/00*** | (2006.01) |

(52) U.S. Cl.

CPC ..... *E01F 9/654* (2016.02); *E01F 9/688* (2016.02); *G09F 7/00* (2013.01); *G09F 7/18* (2013.01)

(58) Field of Classification Search

CPC ..... E01F 9/026; E01F 9/669; E01F 9/692
USPC ..... 116/63 C; 404/9; D10/113.2; 40/607.03
See application file for complete search history.

(56) References Cited

U.S. PATENT DOCUMENTS

| | | | | |
|---|---|---|---|---|
| 2,762,327 A * | 9/1956 | Weig | E01F 9/688 | 116/63 C |
| 3,099,244 A * | 7/1963 | Knapp | E01F 9/688 | 116/63 C |
| 3,451,368 A * | 6/1969 | Keats | E01F 9/688 | 116/63 C |
| 4,779,955 A * | 10/1988 | Schmanski | E01F 9/619 | 116/63 R |
| 4,925,334 A | 5/1990 | Beard | | |
| 5,918,394 A * | 7/1999 | Babcock | B42D 5/047 | 40/122 |
| 6,769,207 B1 * | 8/2004 | Brown | G09F 7/18 | 40/607.12 |

(Continued)

FOREIGN PATENT DOCUMENTS

| | | | |
|---|---|---|---|
| GB | 2077332 A * | 12/1981 | E01F 9/688 |
| GB | 2213854 | 8/1989 | |

(Continued)

OTHER PUBLICATIONS

U.S. Appl. No. 62/294,053, filed Feb. 11, 2016.

*Primary Examiner* — Joanne Silbermann
(74) *Attorney, Agent, or Firm* — Perkins Coie LLP

(57) ABSTRACT

Disclosed herein are embodiments of a portable sign for removable disposition about a traffic control device, and methods of making and using such a portable sign, whereby the portable sign includes a sleeve having sleeve outer and inner surfaces, the sleeve inner surface defining a sleeve opening configured to removably receive the traffic control device; a panel coupled to the sleeve in overlaying engagement; and an information-conveying indicium coupled to the panel, for example an information-conveying indicium associated with the traffic control device.

15 Claims, 12 Drawing Sheets

(56) References Cited

U.S. PATENT DOCUMENTS

| | | | | |
|---|---|---|---|---|
| 8,544,407 | B2 | 10/2013 | Spray | |
| 8,777,512 | B2 | 7/2014 | Henderson | |
| 9,371,619 | B2 * | 6/2016 | Intagliata ..... | E01F 9/608 |
| 2014/0069320 | A1 | 3/2014 | Wang | |

FOREIGN PATENT DOCUMENTS

| | | |
|---|---|---|
| GB | 2270332 | 3/1994 |
| GB | 2289492 | 11/1995 |
| WO | WO 2004/103770 | 12/2004 |

* cited by examiner

1/30
ROAD CLOSED
17
3
4/5
13
2/10

1/31
4/6
12
ROAD CLOSED
4/5
17
3
13
2/10

1/31
4/5
14
ROAD CLOSED
13
17
3
2/10

1/30
8
4/5/32
4/5/33
9

1/30
8
4/5/33
4/5/32

1/30
7
ROAD
CLOSED
3
17/24
23
8
9
4/5/32

1/30
9
4/5/32
4/5/33

1/30
4/5/33
8
9

1/30
8
4/5/33
4/5/32
9

1/30
ROAD CLOSED
17
4/5
3
2
13

1/31
4/6
12
ROAD CLOSED
4/5
17
3
13
2

1/31
14
ROAD CLOSED
4/5
17
3
13
2

PORTABLE SIGN FOR A TRAFFIC CONTROL DEVICE

This United States Non-Provisional Patent Application claims the benefit of U.S. Provisional Patent Application No. 62/294,053, filed Feb. 11, 2016, hereby incorporated by reference herein.

I. SUMMARY OF THE INVENTION

A broad object of a particular embodiment of the invention can be to provide a portable sign for removable disposition about a traffic control device, and methods of making and using such a portable sign, whereby the portable sign includes a sleeve having sleeve outer and inner surfaces, the sleeve inner surface defining a sleeve opening configured to removably receive the traffic control device; a panel coupled to the sleeve in overlaying engagement; and an information-conveying indicium coupled to the panel, for example an information-conveying indicium associated with the traffic control device.

Naturally, further objects of the invention are disclosed throughout other areas of the specification, drawings, and claims.

II. A BRIEF DESCRIPTION OF THE DRAWINGS

III. DETAILED DESCRIPTION OF THE PREFERRED EMBODIMENTS

Figure 1A:
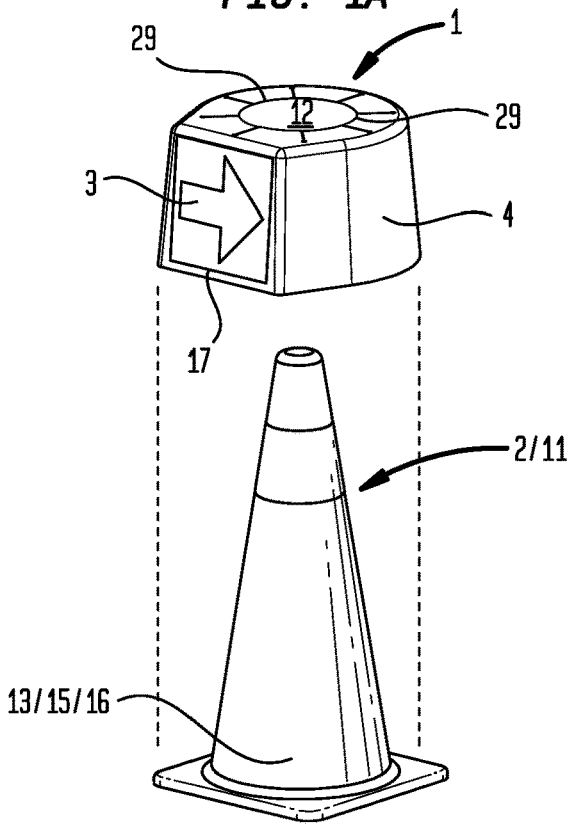
FIG. 1A is an illustration of a particular embodiment of a portable sign which can be removably disposed about a traffic control device, such as a traffic cone.

Now referring primarily to FIG. 1A, FIG. 1B, FIG. 3A through FIG. 3C, and FIG. 7A through FIG. 7C, which illustrate methods of using particular embodiments of a portable sign (1) to convey information, whereby the method includes removably disposing the portable sign (1) about a traffic control device (2) to display an information-conveying indicium (3), for example an information-conveying indicium (3) associated with the traffic control device (2). Following use, the method can further include removing or disengaging the portable sign (1) from the traffic control device (2) without comprising the integrity of the portable sign (1) or the traffic control device (2), whereby the portable sign (1) and the traffic control device (2) can then be reused (whether separately or together), transported, stored, or the like.

Now referring primarily to FIG. 2A through FIG. 2H, FIG. 4A through FIG. 5H, FIG. 8A, and FIG. 8B, the portable sign (1) includes a sleeve (4) having opposing sleeve outer and inner surfaces (5)(6) which extend along a sleeve length (7) between sleeve upper and lower ends (8)(9).

Now referring primarily to FIG. 5A through FIG. 5H, as to particular embodiments, the sleeve (4) can, but need not necessarily, be configured as a generally cylindrical sleeve (4) having a generally circular cross-section, whereby the sleeve diameter remains substantially constant along the sleeve length (7). As but one illustrative example, this embodiment may be useful for disposition about a generally cylindrical traffic control device (2), such as a traffic barrel (10).

Now referring primarily to FIG. 2A through FIG. 2H, FIG. 8A, and FIG. 8B, as to other particular embodiments, the sleeve (4) can, but need not necessarily, be configured as a generally conical sleeve (4) or as a truncated conical sleeve (4), whereby the sleeve diameter lessens approaching the sleeve upper end (8) such that the sleeve (4) inwardly tapers along the sleeve length (7) toward the sleeve upper end (8). As but one illustrative example, this embodiment may be useful for disposition about a traffic control device (2) which inwardly tapers toward its upper end, such as a traffic cone (11).

The sleeve (4) can be formed from any of a numerous and wide variety of materials capable of being disposed about a traffic control device (2) and capable of withstanding conditions to which traffic control devices (2) can be exposed, such as weather-related conditions. For example, the sleeve (4) can be formed from a water-resistant or water-proof material.

As to particular embodiments, the material can be substantially rigid, semi-rigid, flexible, or the like, or combinations thereof, depending upon the application. As non-limiting examples, the material can include a polymeric material, a plastic material, a plastic-like material, polyethylene (PE), polyvinyl chloride (PVC), polypropylene (PP), polystyrene (PS), polyamides (PA), acrylonitrile butadiene styrene (ABS), polycarbonate (PC), polyurethane (PU), or the like, or combinations thereof.

As to particular embodiments, the material can be substantially translucent or transparent, thereby allowing the color of the traffic control device (2), for example safety orange, to be viewable through the material when the sleeve (4) removably disposes about the traffic control device (2). Accordingly, the instant translucent or transparent sleeve (4) does not obscure the color of the traffic control device (2) or obscures the color of the traffic control device (2) to a lesser degree than an opaque or substantially opaque sleeve (4), which may be beneficial for obvious safety reasons.

Now referring primarily to FIG. 2A through FIG. 2H, FIG. 4A through FIG. 5H, FIG. 8A, and FIG. 8B, the sleeve inner surface (6) defines a sleeve opening (12) communicating between the sleeve upper and lower ends (8)(9), whereby the sleeve opening (12) is configured to removably receive the traffic control device (2) for removable disposition of the sleeve (4) about the traffic control device (2).

As to particular embodiments, upon removable disposition, the sleeve (4) can laterally surround the traffic control device (2) or entirely laterally surround the traffic control device (2) or entirely surround a circumference of the traffic control device (2) (as shown in the examples of the Figures); however, the invention need not be so limited and it is herein contemplated that, as to other particular embodiments, the sleeve (4) can only partially laterally surround the traffic control device (2) or only partially surround the circumference of the traffic control device (2).

Now referring primarily to FIG. 1A, FIG. 1B, FIG. 3A through FIG. 3C, and FIG. 7A through FIG. 7C, upon removable reception of the traffic control device (2) within the sleeve opening (12), the sleeve inner surface (6) can dispose adjacent or directly adjacent a traffic control device external surface (13), thus contacting the traffic control device (2) and frictionally engaging with the traffic control device external surface (13) to fixedly couple the sleeve (4) to the traffic control device (2). Upon fixed coupling, the sleeve (4) can be precluded from moving in relation to the traffic control device external surface (13), even upon forcible urging, such as forcible urging which may be provided by a weather-related condition, for example a windy condition.

Accordingly, the inventive portable sign (1) may be preferable over conventional signs or other attachments for traffic control devices (2), which may be susceptible to movement under windy conditions, whereby the movement may preclude viewing of information intended to be directionally displayed by the conventional sign or other attachments for traffic control devices (2).

Figure 1B:
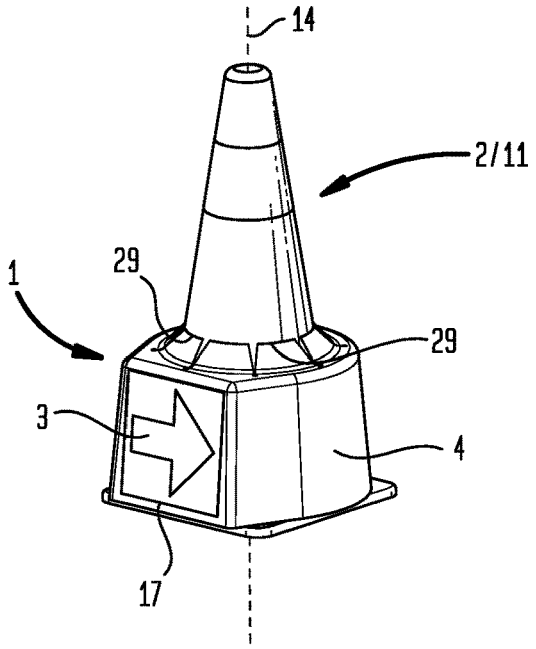
FIG. 1B is an illustration of a method of using the particular embodiment of the portable sign shown in FIG. 1A, whereby the portable sign is removably disposed about the traffic cone.
Figure 2A:
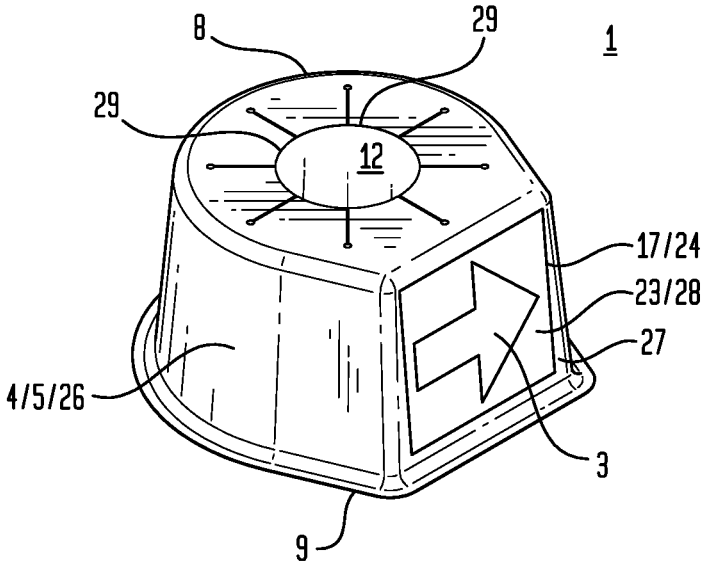
FIG. 2A is a perspective view of a particular embodiment of a portable sign.
Figure 2B:
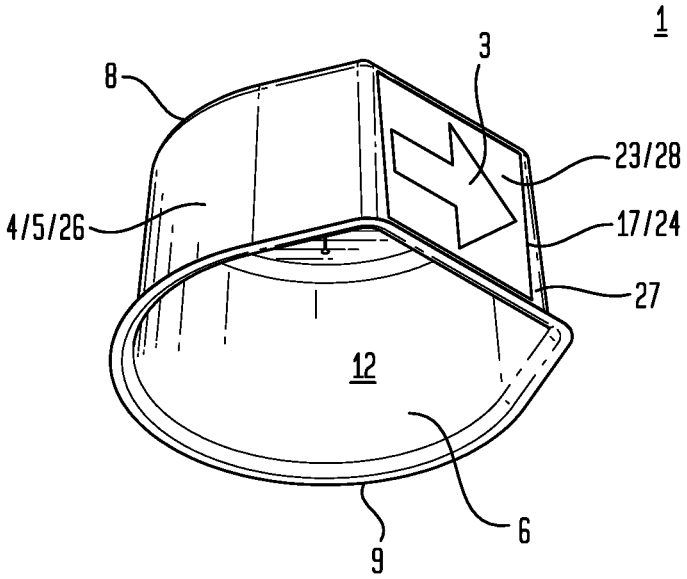
FIG. 2B is a perspective view of the particular embodiment of the portable sign shown in FIG. 2A.
Figure 2F:
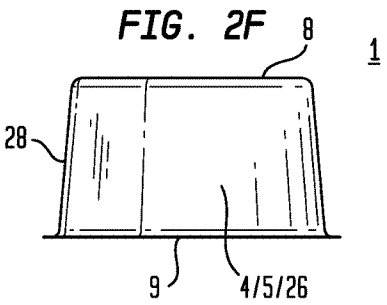
FIG. 2F is a second side view of the particular embodiment of the portable sign shown in FIG. 2A.
Figure 2D:
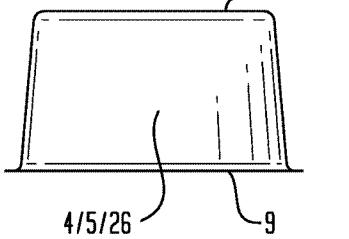
FIG. 2D is a rear view of the particular embodiment of the portable sign shown in FIG. 2A.
Figure 2G:
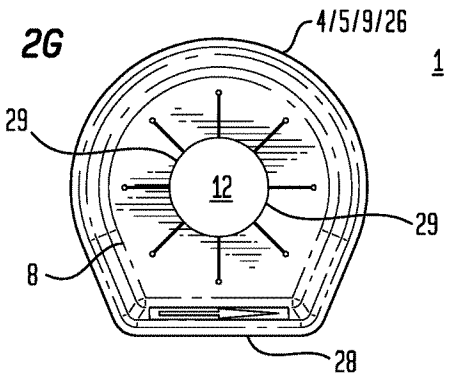
FIG. 2G is a top view of the particular embodiment of the portable sign shown in FIG. 2A.
Figure 2C:
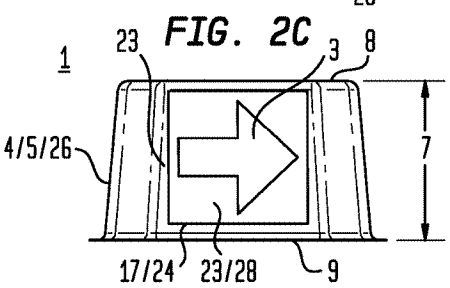
FIG. 2C is a front view of the particular embodiment of the portable sign shown in FIG. 2A.
Figure 2H:
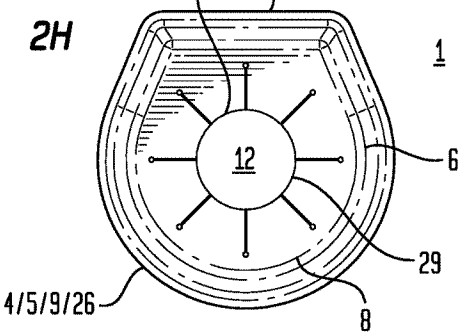
FIG. 2H is a bottom view of the particular embodiment of the portable sign shown in FIG. 2A.
Figure 2E:
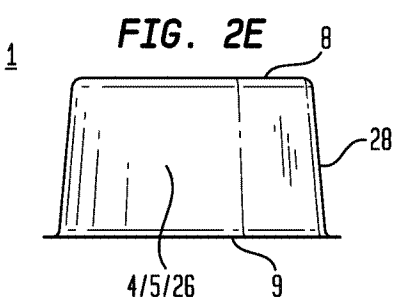
FIG. 2E is a first side view of the particular embodiment of the portable sign shown in FIG. 2A.
Figures 3A, 3B, 3C:
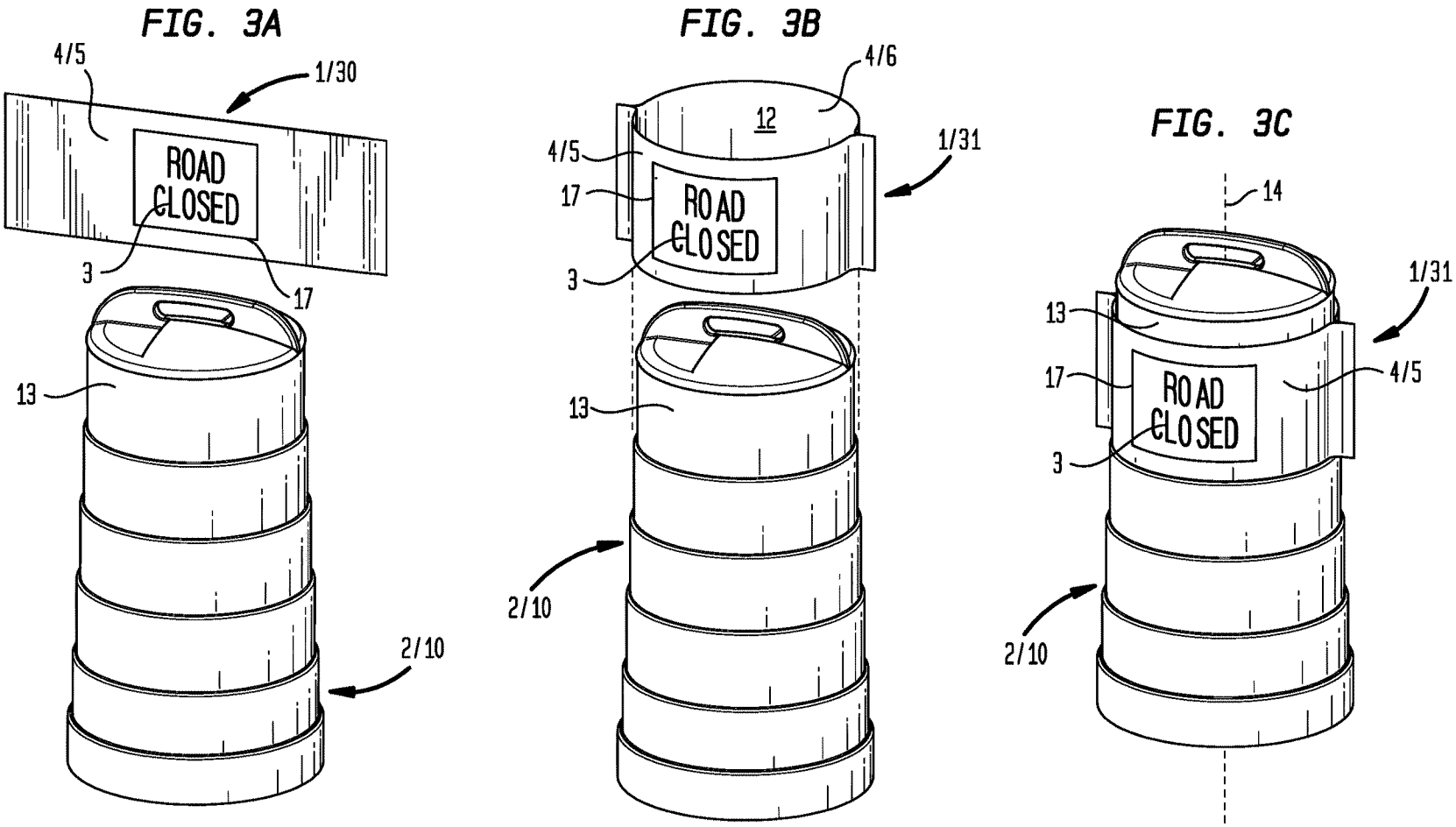
FIG. 3A is an illustration of a particular embodiment of a portable sign which can be removably disposed about a traffic control device, such as a traffic barrel, whereby the portable sign disposes in a collapsed condition.
FIG. 3B is an illustration of the particular embodiment of the portable sign shown in FIG. 3A, but whereby the portable sign disposes in an expanded condition.
FIG. 3C is an illustration of a method of using the particular embodiment of the portable sign shown in FIG. 3B, whereby the portable sign is removably disposed about the traffic barrel.
Figure 4A:
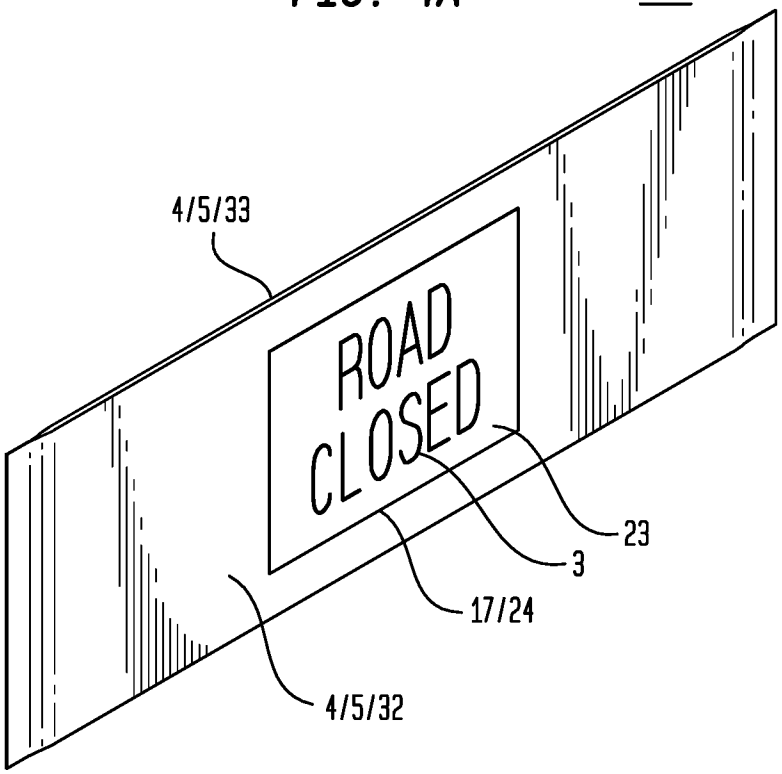
FIG. 4A is a perspective view of a particular embodiment of a portable sign disposed in a collapsed condition.
Figures 4B, 4C, 4D, 4E, 4F, 4G:
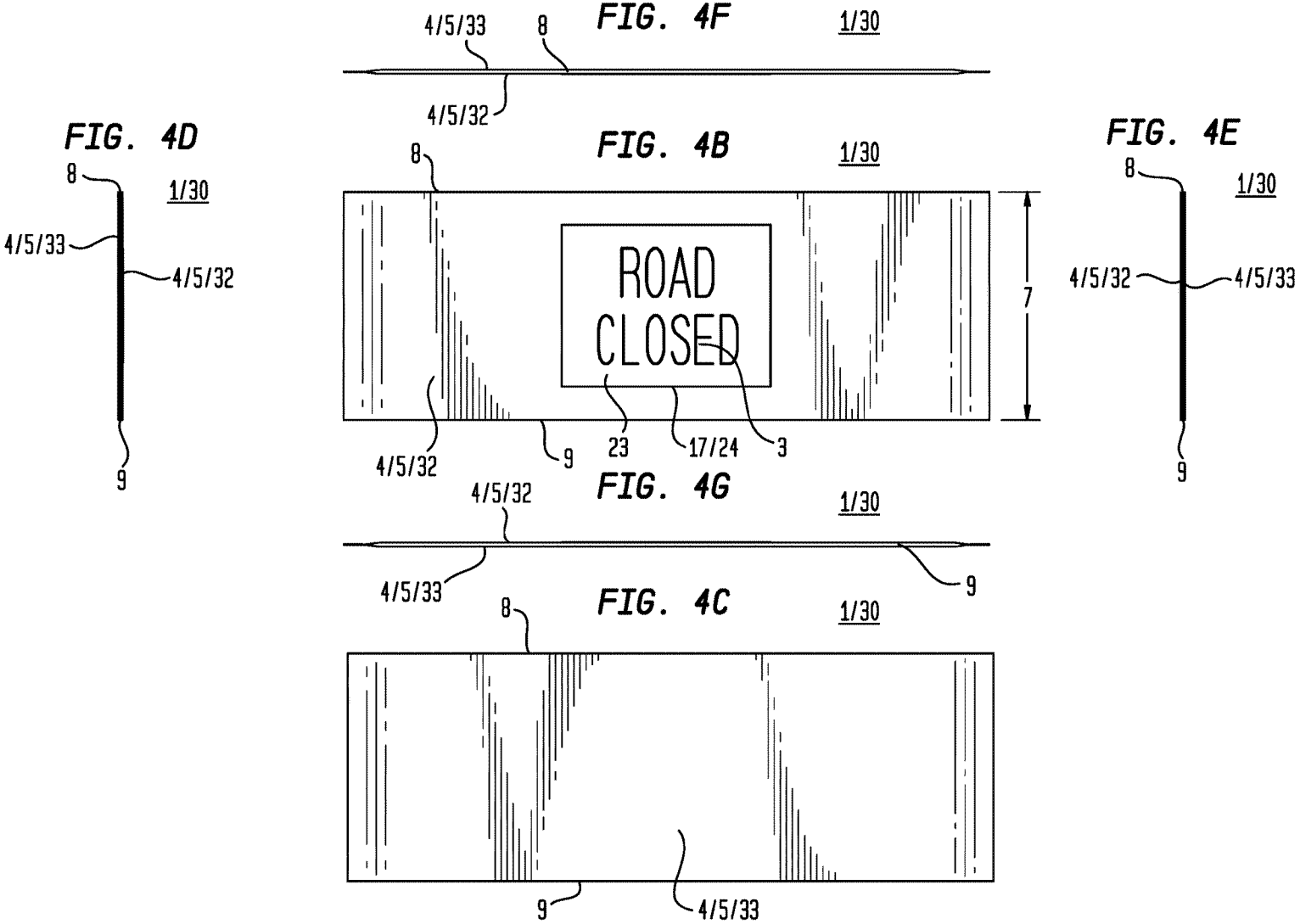
FIG. 4B is a front view of the particular embodiment of the portable sign shown in FIG. 4A.
FIG. 4C is a rear view of the particular embodiment of the portable sign shown in FIG. 4A.
FIG. 4D is a first side view of the particular embodiment of the portable sign shown in FIG. 4A.
FIG. 4E is a second side view of the particular embodiment of the portable sign shown in FIG. 4A.
FIG. 4F is a top view of the particular embodiment of the portable sign shown in FIG. 4A.
FIG. 4G is a bottom view of the particular embodiment of the portable sign shown in FIG. 4A.
Figure 5A:
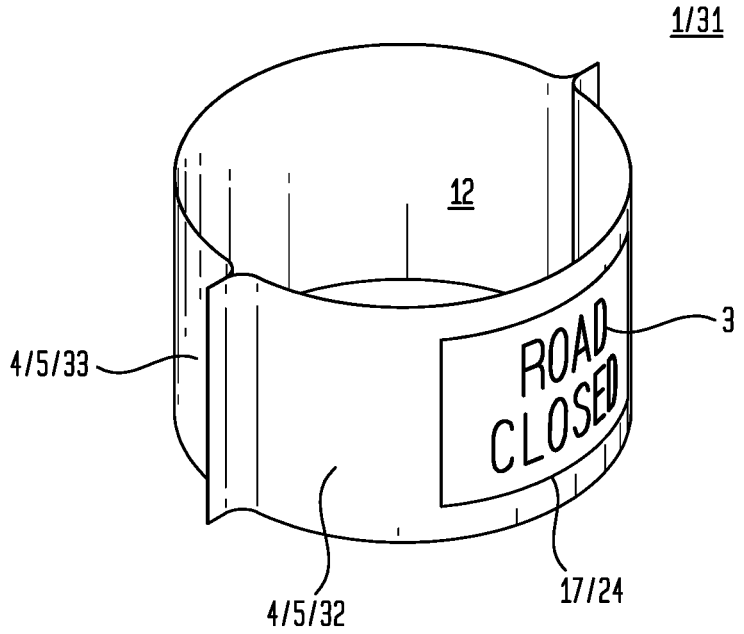
FIG. 5A is a perspective view of a particular embodiment of a portable sign disposed in an extended condition.
Figure 5B:
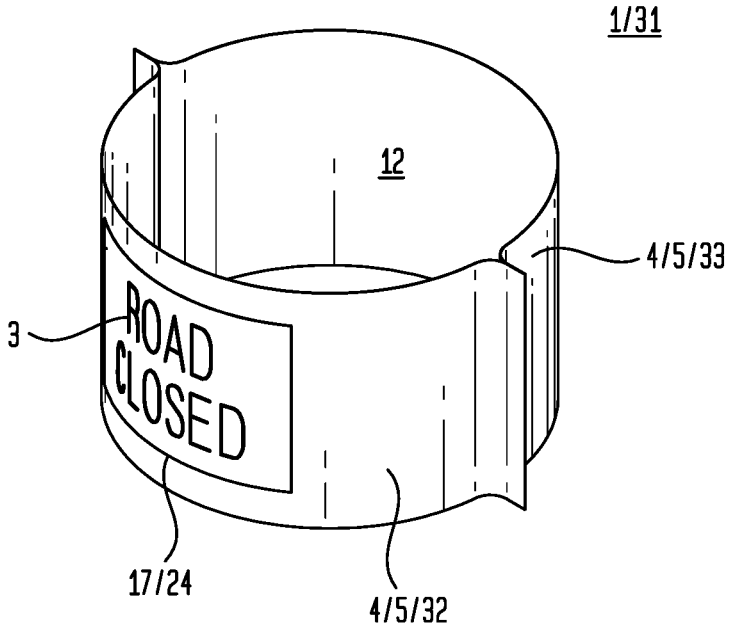
FIG. 5B is a perspective view of the particular embodiment of the portable sign shown in FIG. 5A.
Figure 5F:
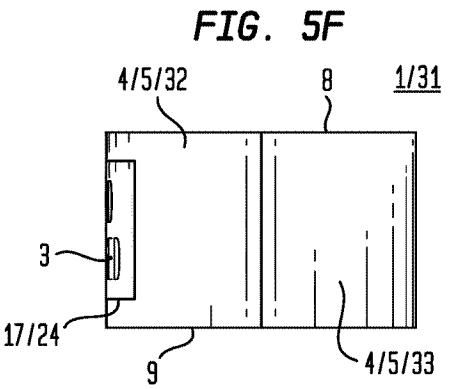
FIG. 5F is a second side view of the particular embodiment of the portable sign shown in FIG. 5A.
Figure 5D:
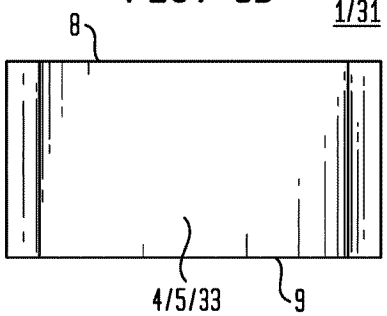
FIG. 5D is a rear view of the particular embodiment of the portable sign shown in FIG. 5A.
Figure 5G:
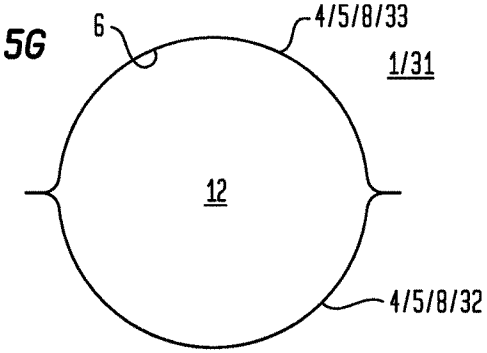
FIG. 5G is a top view of the particular embodiment of the portable sign shown in FIG. 5A.
Figure 5C:
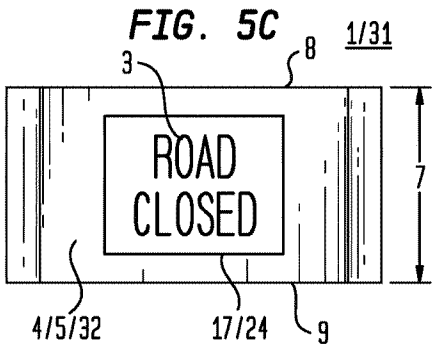
FIG. 5C is a front view of the particular embodiment of the portable sign shown in FIG. 5A.
Figure 5H:
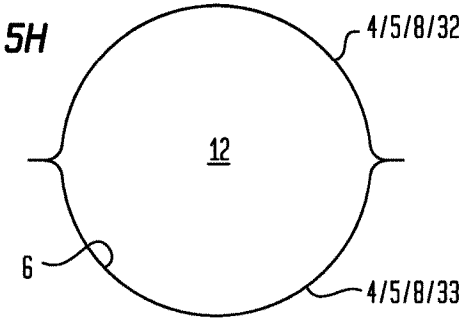
FIG. 5H is a bottom view of the particular embodiment of the portable sign shown in FIG. 5A.
Figure 5E:
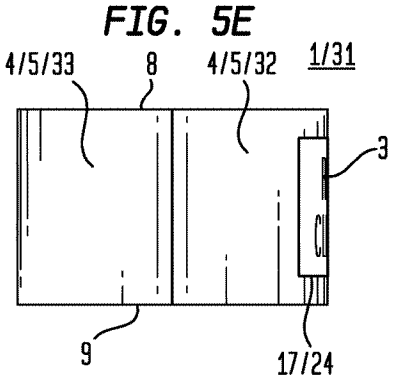
FIG. 5E is a first side view of the particular embodiment of the portable sign shown in FIG. 5A.
Figure 6:
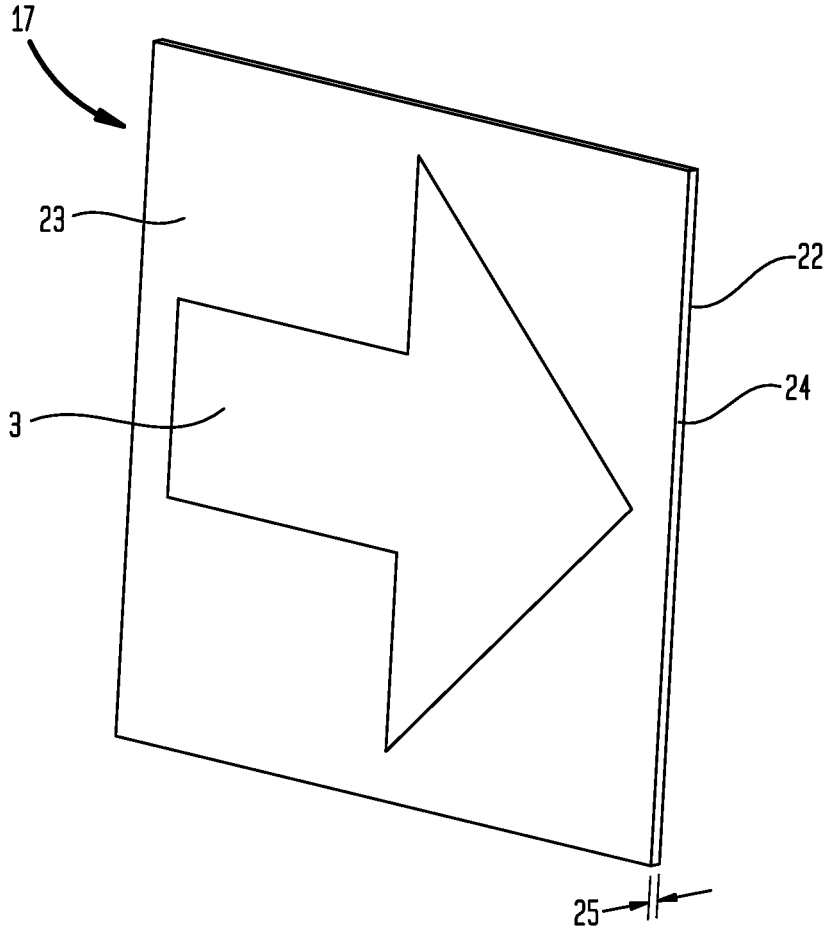
FIG. 6 is a perspective view of a particular embodiment of a panel of a portable sign.
Figures 7A, 7B, 7C:
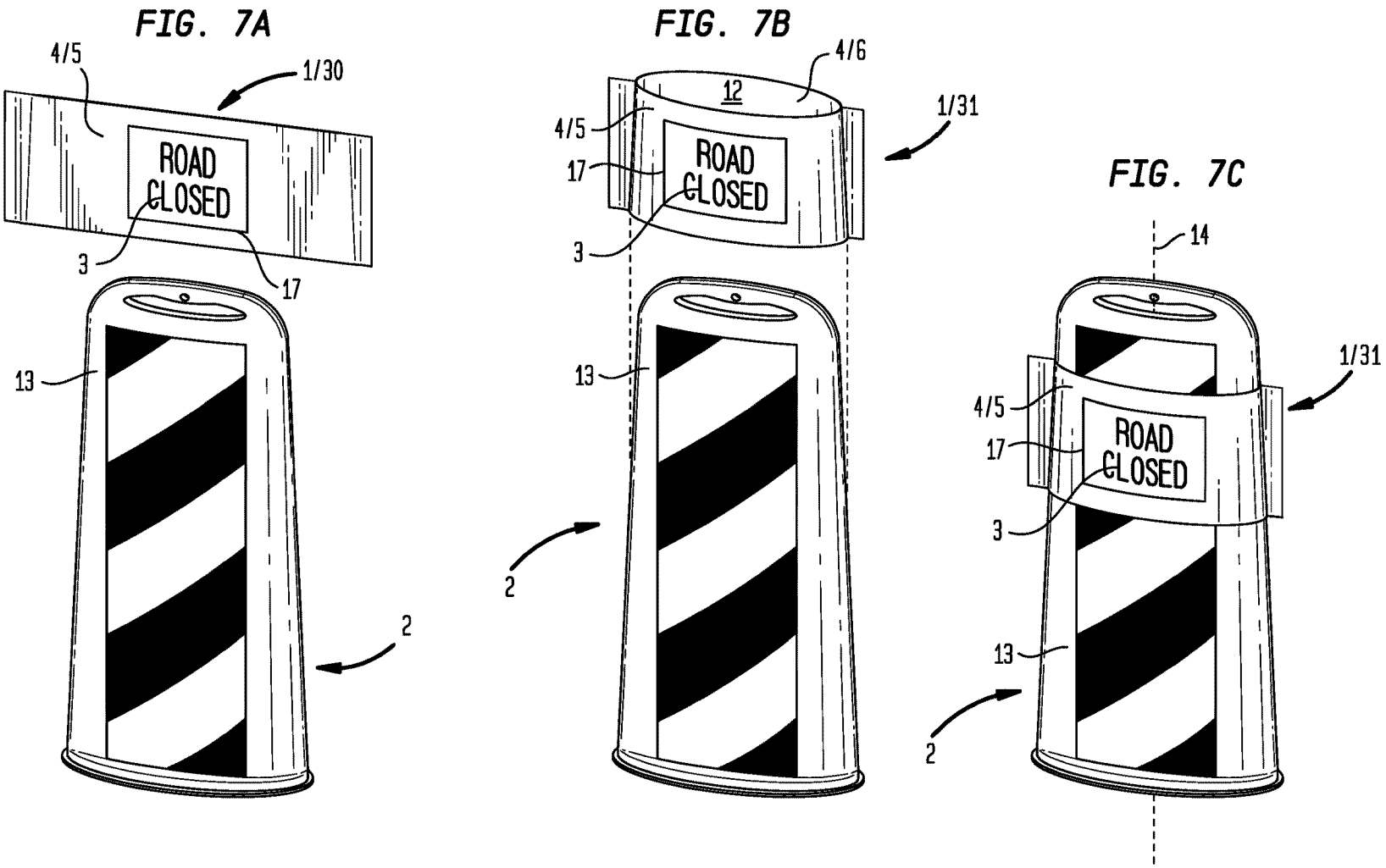
FIG. 7A is an illustration of a particular embodiment of a portable sign which can be removably disposed about a traffic control device, such as a pylon, whereby the portable sign disposes in a collapsed condition.
FIG. 7B is an illustration of the particular embodiment of the portable sign shown in FIG. 7A, but whereby the portable sign disposes in an expanded condition.
FIG. 7C is an illustration of a method of using the particular embodiment of the portable sign shown in FIG. 7B, whereby the portable sign is removably disposed about the pylon.

As but one illustrative example, the movement precluded by the fixed coupling of the sleeve (4) to the traffic control device (2) can include rotational movement of the sleeve (4) about the traffic control device external surface (13) or about a longitudinal axis (14) shared by the sleeve (4) and the traffic control device (2) (as shown in the examples of FIG. 1B, FIG. 3C, and FIG. 7C).

As another illustrative example, the movement precluded by the fixed coupling of the sleeve (4) to the traffic control device (2) can include vertical movement of the sleeve (4) along the traffic control device external surface (13) or along the longitudinal axis (14) shared by the sleeve (4) and the traffic control device (2) (as shown in the examples of FIG. 1B, FIG. 3C, and FIG. 7C).

As to particular embodiments, frictional engagement of the sleeve inner surface (6) with the traffic control device external surface (13) can be sufficient to fixedly couple the sleeve (4) to the traffic control device (2); consequently, fasteners, such as adhesives or mechanical fasteners, may not be needed or required for this purpose.

Now referring primarily to FIG. 1B, as to particular embodiments, the sleeve inner surface (6) can define a sleeve opening (12) configured to removably receive the traffic control device (2) for removable disposition of the sleeve (4) about a traffic control device bottom portion (15). Correspondingly, the center of gravity of the traffic control device (2) may not be significantly altered upon removable disposition of the portable sign (1) such that the center of gravity remains proximate the traffic control device bottom portion (15), which may preclude the traffic control device (2) from tipping or falling over, particularly upon exposure to a weather-related condition, for example a windy condition.

Accordingly, the inventive portable sign (1) may be preferable over conventional signs, which may have a center of gravity distal from their bottom portions, for example proximate their top portions. Thus, conventional signs may be more susceptible to tipping or falling over, particularly upon exposure to a weather-related condition, for example a windy condition, whereby tipping or falling over may preclude viewing of information intended to be directionally displayed by the conventional sign.

Additionally, the inventive portable sign (1) may be preferable over other attachments for traffic control devices (2), which upon attaching to the traffic control device (2), may alter the center of gravity away from the traffic control device bottom portion (15), for example proximate a traffic control device top portion. Thus, these types of attachments may make the associated traffic control device (2) more susceptible to tipping or falling over, particularly upon exposure to a weather-related condition, for example a windy condition, whereby tipping or falling over may preclude viewing of information intended to be directionally displayed by the attachment.

As to particular embodiments, the sleeve inner surface (6) can define a sleeve opening (12) configured to removably receive any one of a plurality of traffic control devices (2) for removable disposition of the sleeve (4) about the traffic control device (2).

As but one illustrative example, the sleeve inner surface (6) can define a sleeve opening (12) configured to removably receive various sizes of traffic cones (12), whereby the same sleeve (4) can be removably disposed about a 12 inch traffic cone (11), an 18 inch traffic cone (11), a 28 inch traffic cone (11), or a 36 inch traffic cone (11), depending upon the application.

If the differently-sized traffic cones (12) inwardly taper toward their upper end at varying angles, the sleeve (4) can removably dispose at corresponding varying positions along a traffic cone external surface (16). For example, the sleeve (4) can dispose closer to a traffic cone bottom portion (15) of a traffic cone (11) with a greater angle of inward taper relative to a traffic cone (11) with a lesser angle of inward taper, as the position of the sleeve (4) along the traffic cone external surface (16) can be dependent upon the circumference of the sleeve opening (12).

Now referring primarily to FIG. 2A through FIG. 2H, FIG. 4A through FIG. 5H, FIG. 8A, and FIG. 8B, the portable sign (1) further includes an information-conveying indicium (3) coupled to the sleeve (4), whereby the information-conveying indicium (3) can be any of a numerous and wide-variety of information-conveying indicia (3) which may be useful to provide information and/or for directing or controlling traffic, as would be known to one of ordinary skill in the art and/or as can be found in the Manual on Uniform Traffic Control Devices (MUTCD) published by the Federal Highway Administration (FHWA). As non-limiting examples, the traffic-conveying indicium (3) can include a symbol, such as an arrow or an intersection symbol; one or more letters and/or words, such as "Stop", Slow", "Yield", or "Road Work Ahead"; one or more numbers, such as "45" to indicate a speed limit or route marker; etc.

As to particular embodiments, the information-conveying indicium (3) can be integrated with the sleeve (4) during production of the sleeve (4), whereby the information-conveying indicium (3) can be visible on the sleeve outer surface (5) following production.

As to other particular embodiments, the information-conveying indicium (3) can be disposed on the sleeve outer surface (5) (for example via etching, writing, inking, painting, or printing) during or following production of the sleeve (4).

As to yet other particular embodiments, the information-conveying indicium (3) can be coupled to, connected to, directly connected to, or integrated with the panel (17), whereby the panel (17) can be coupled to the sleeve (4) in overlaying engagement such that the panel (17) can dispose over the sleeve (4) and particularly, over the sleeve outer surface (5).

As to particular embodiments, the panel (17) (and more specifically, the panel inner face (22)) can be permanently coupled, permanently connected, or permanently directly connected to the sleeve outer surface (5) to permanently attach the panel (17) to the sleeve (4) in overlaying engagement so as to be incapable of being easily separated without destroying the integrity of the panel (17) or the sleeve (4).

As to other particular embodiments, the panel (17) (and more specifically, the panel inner face (22)) can be removably coupled, removably connected, or removably directly connected to the sleeve outer surface (5) to removably attach the panel (17) to the sleeve (4) in overlaying engagement. Accordingly, the panel (17) can be temporarily attached to the sleeve (4) in overlaying engagement so as to be capable of being easily separated from the sleeve (4) without destroying the integrity of the panel (17) or the sleeve (4).

Figure 8A:
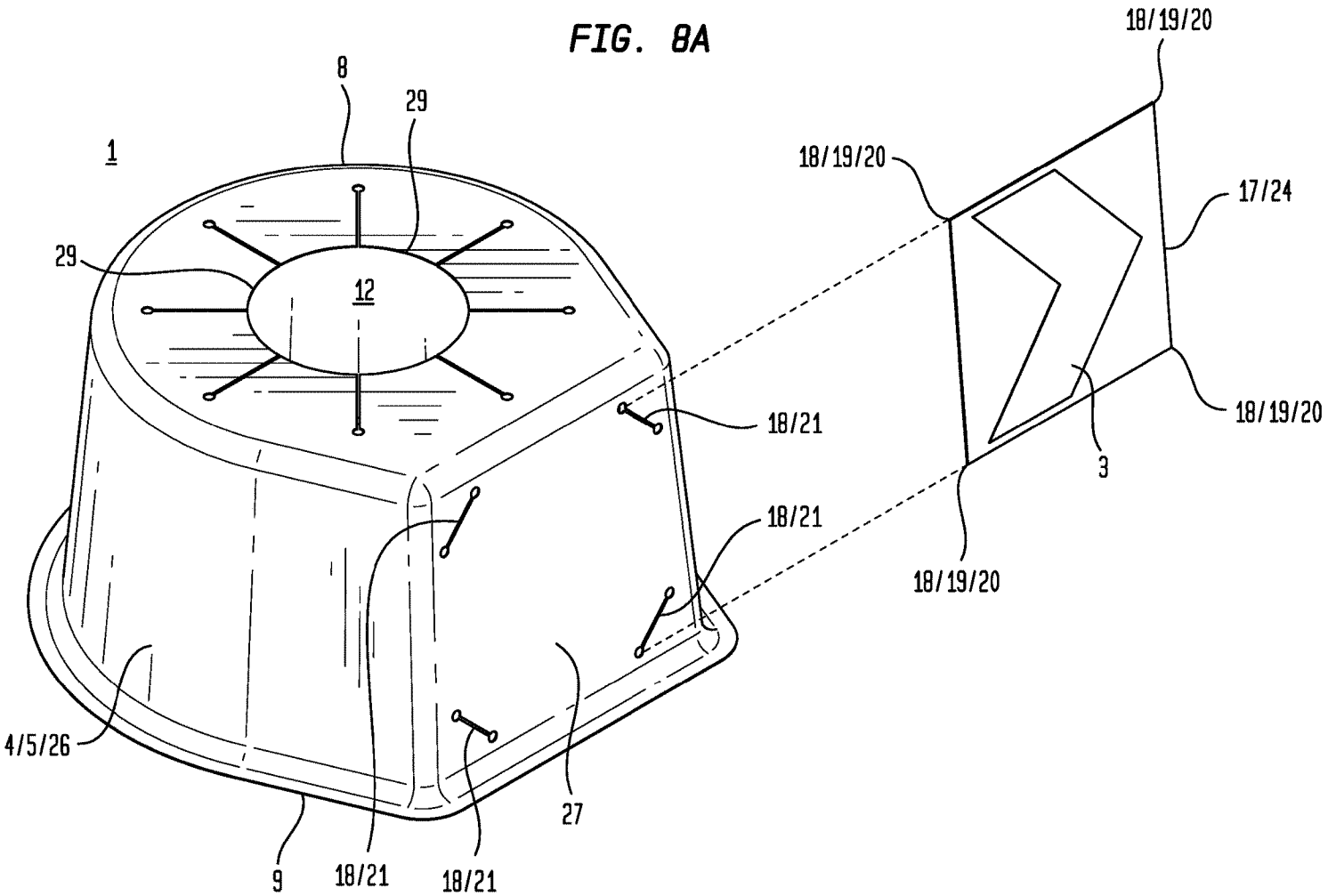
FIG. 8A is an illustration of a particular embodiment of a portable sign including a panel exploded from a sleeve, whereby the panel and the sleeve can be coupled via a tab and slot system.
Figure 8B:
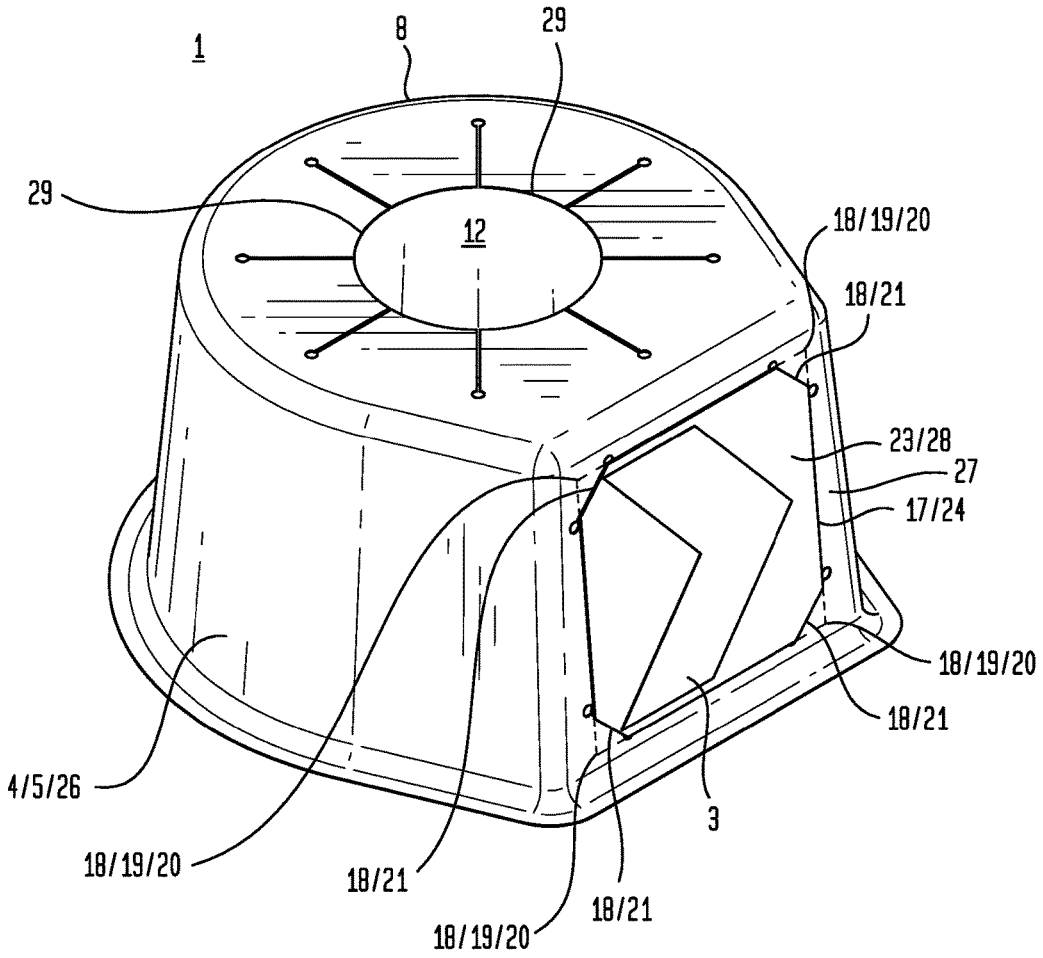
FIG. 8B is an illustration of the portable sign shown in FIG. 8A, whereby the panel is coupled to the sleeve via the tab and slot system.

Concerning coupling mechanisms, the panel (17) can be coupled to the sleeve (4) in overlaying engagement via any of a numerous and wide variety of securement systems, such as via adhesive(s), mechanical fastener(s), or a via a tab and slot system (18) (as shown in the examples of FIG. 8A and FIG. 8B) which may not require any extraneous securement elements, such as adhesive or mechanical fasteners, to secure the panel (17) to the sleeve (4).

Regarding the tab and slot system (18), one or more tabs (19) may be integrated with the panel (17), whereby a portion of the panel (17), for example a panel corner portion (20), provides a tab (19); additionally, one or more slots (21) may be integrated with the sleeve (4), whereby each slot (21) can be disposed within the sleeve (4) to communicate between sleeve outer and inner surfaces (5)(6). To secure the panel (17) to the sleeve (4), a tab (19) can be passed through a corresponding slot (21) to secure the panel (17) to the sleeve (4) (as shown in the example of FIG. 8B).

Now referring primarily to FIG. 2A through FIG. 2H, FIG. 4A through FIG. 5H, FIG. 6, FIG. 8A, and FIG. 8B, the panel (17) includes opposing panel inner and outer faces (22)(23) defined by a panel perimeter (24).

Now concerning the panel perimeter (24), as to particular embodiments, a portion of the panel perimeter (24) can be coupled, connected, or directly connected to the sleeve outer surface (5) in overlaying engagement.

Now referring primarily to FIG. 2A through FIG. 2H, FIG. 4A through FIG. 5H, FIG. 8A, and FIG. 8B, as to other particular embodiments, the entirety of the panel perimeter (24) can be coupled, connected, or directly connected to the sleeve outer surface (5) in overlaying engagement such that the panel (17) does not outwardly extend, whether tangentially or radially, from the sleeve outer surface (5) or does not substantially outwardly extend, whether tangentially or radially, from the sleeve outer surface (5). For example, the panel (17) may not at all tangentially outwardly extend from the sleeve outer surface (5) and the panel (17) may only radially outwardly extend from the sleeve outer surface (5) by a panel thickness (25).

Thus, the panel (17) and, correspondingly, the inventive portable sign (1), may be less prone to movement in relation to conventional signs or other attachments for traffic control devices (2), as the instant portable sign (1) provides a lesser amount of drag or air resistance. Even upon forcible urging, such as forcible urging which may be provided by a weather-related condition, for example a windy condition, the instant portable sign (1) may not be prone to movement about or along the traffic control device external surface (13).

Now concerning the panel inner face (22), as to particular embodiments, a portion of the panel inner face (22) can be coupled, connected, or directly connected to the sleeve outer surface (5) in overlaying engagement.

Again referring primarily to FIG. 2A through FIG. 2H, FIG. 4A through FIG. 5H, FIG. 8A, and FIG. 8B, as to other particular embodiments, the entirety of the panel inner face (22) can be coupled, connected, or directly connected to the sleeve outer surface (5) in overlaying engagement such that the panel (17) does not outwardly extend, whether tangentially or radially, from the sleeve outer surface (5) or does not substantially outwardly extend, whether tangentially or radially, from the sleeve outer surface (5). For example, the panel (17) may not at all tangentially outwardly extend from the sleeve outer surface (5) and the panel (17) may only radially outwardly extend from the sleeve outer surface (5) by a panel thickness (25).

Thus, the panel (17) and, correspondingly, the inventive portable sign (1), may be less prone to movement in relation to conventional signs or other attachments for traffic control devices (2), as the instant portable sign (1) provides a lesser amount of drag or air resistance. Even upon forcible urging, such as forcible urging which may be provided by a weather-related condition, for example a windy condition, the instant portable sign (1) may not be prone to movement about or along the traffic control device external surface (13).

Again referring primarily to FIG. 2A through FIG. 2H, FIG. 4A through FIG. 5H, FIG. 8A, and FIG. 8B, as to particular embodiments, the panel inner face (22) can dispose in generally adjacent relation, in adjacent relation, or in directly adjacent relation to the portion of the sleeve outer surface (5) which the panel (17) overlays such that the panel (17) does not outwardly extend, whether tangentially or radially, from the sleeve outer surface (5) or does not substantially outwardly extend, whether tangentially or radially, from the sleeve outer surface (5). For example, the panel (17) may not at all tangentially outwardly extend from the sleeve outer surface (5) and the panel (17) may only radially outwardly extend from the sleeve outer surface (5) by a panel thickness (25). Accordingly, the panel outer face (23) can dispose in generally parallel relation or in parallel relation to the portion of the sleeve outer surface (5) which the panel (17) overlays, whereby the panel outer face (23) disposes a panel thickness (25) apart from the sleeve outer surface (5).

Thus, the panel (17) and, correspondingly, the inventive portable sign (1), may be less prone to movement in relation to conventional signs or other attachments for traffic control devices (2), as the instant portable sign (1) provides a lesser amount of drag or air resistance. Even upon forcible urging, such as forcible urging which may be provided by a weather-related condition, for example a windy condition, the instant portable sign (1) may not be prone to movement about or along the traffic control device external surface (13).

Now referring primarily to FIG. 1A through FIG. 2G, FIG. 8A, and FIG. 8B, which show but one illustrative example of a particular embodiment of the inventive portable sign (1) which has a lesser amount of drag or air resistance as compared to conventional signs or other attachments for traffic control devices (2). As to this embodiment, the sleeve (4) is configured as a truncated conical sleeve (4) having an arcuate lateral portion (26) coupled to, connected to, or directly connected to a generally planar lateral portion (27). Further, a generally planar panel (17) is coupled to the generally planar lateral portion (27) of the sleeve (4) to provide a generally planar viewable surface (28), whereby an information-conveying indicium (3) disposed on the generally planar viewable surface (28) may be more easily viewed than if disposed on a contoured or arcuate surface.

Now referring primarily to FIG. 1B, FIG. 3C, FIG. 7C, and FIG. 8B, the instant portable sign (1) can have a substantially uniform distribution of mass. Correspondingly, the center of gravity of the traffic control device (2) may not be significantly altered upon removable disposition of the portable sign (1) such that the center of gravity remains proximate the center of the traffic control device (2) (as opposed to the periphery), which may preclude the traffic control device (2) from tipping or falling over, particularly upon exposure to a weather-related condition, for example a windy condition.

Accordingly, the inventive portable sign (1) may be preferable over other attachments for traffic control devices (2), which upon attaching to the traffic control device (2), may alter the center of gravity away from the center of the traffic control device (2), for example toward a periphery of the traffic control device (2). Thus, these types of attachments may make the associated traffic control device (2) more susceptible to tipping or falling over, particularly upon exposure to a weather-related condition, for example a windy condition, whereby tipping or falling over may preclude viewing of information intended to be directionally displayed by the attachment.

Now referring primarily to FIG. 1B, FIG. 2A, FIG. 2G, and FIG. 2H, as to particular embodiments, the portable sign (1) can, but need not necessarily, further include one or more flanges (29) coupled to the sleeve (4) proximate the sleeve opening (12). The flange (29) can contact the traffic control device (2) and frictionally engage with the traffic control device external surface (13) to enhance the coupling of the sleeve (4) to the traffic control device (2), thereby precluding movement about or along the traffic control device external surface (13), even upon forcible urging, such as forcible urging which may be provided by a weather-related condition, for example a windy condition.

Again referring primarily to FIG. 1B, FIG. 2A, FIG. 2G, and FIG. 2H, as to particular embodiments, a plurality of flanges (29) can be coupled to the sleeve (4) proximate the sleeve upper end (8), whereby the flanges (29) inwardly extend into the sleeve opening (12). Upon removable reception of the traffic control device (2) within the sleeve opening (12), the flanges (29) can resiliently upwardly flex about the traffic control device external surface (13) and frictionally engage with the traffic control device external surface (13) to enhance the coupling of the sleeve (4) to the traffic control device (2).

Now referring primarily to FIG. 3A through FIG. 5H, and FIG. 7A through FIG. 7C, as to particular embodiments, the portable sign (1) may be adjustable between a collapsed condition (30) and an expanded condition (31), whereby the portable sign (1) in the collapsed condition (30) can occupy a lesser volume relative to the portable sign (1) in the expanded condition (31). As such, the collapsed condition (30) of the portable sign (1) may be useful for transport, storage, or the like.

Now referring primarily to FIG. 3A through FIG. 5H, as to particular embodiments, in the collapsed condition (30), the portable sign (1) can have a generally planar configuration and in the expanded condition (31), the portable sign (1) can have a generally cylindrical configuration.

As but one illustrative example, to generate the collapsed condition (30), portable sign first and second halves (32)(33) can be disposed in adjacent relation to provide the generally planar condition. To generate the expanded condition (31), the portable sign first and second halves (32)(33) can be outwardly extended from one another to provide the generally cylindrical configuration.

As to particular embodiments, the portable sign (1) can be configured for stackable arrangement such that a plurality of portable signs (1) can be stacked adjacent one another to provide a stack of portable signs (1) which may occupy a lesser volume relative to the same number of portable signs (1) which are not disposed in a stack, whereby stacking the portable signs (1) may be useful for transport, storage, or the like.

A method of making the instant portable sign (1) for removable disposition about a traffic control device (2) includes providing a sleeve (4) having sleeve outer and inner surfaces (5)(6), the sleeve inner surface (5) defining a sleeve opening (12) configured to removably receive the traffic control device (2); coupling a panel (17) to the sleeve (4) in overlaying engagement; and coupling an information-conveying indicium (3) to the panel (17), for example an information-conveying indicium (3) associated with the traffic control device (2).

The method of making the portable sign (1) can further include providing additional components of the portable sign (1) as described above and in the claims.

As to particular embodiments, the portable sign (1) or elements of the portable sign (1) can be produced from any of a wide variety of processes depending upon the application, such as press molding, injection molding, fabrication, machining, printing, three-dimensional printing, or the like, or combinations thereof, as a one-piece construct or assembled from a plurality of pieces into an embodiment of the portable sign (1).

A method of using the instant portable sign (1) includes obtaining the portable sign (1) and removably disposing the portable sign (1) about a traffic control device (2).

The method of using the portable sign (1) can further include utilizing additional components of the portable sign (1) as described above and in the claims.

As can be easily understood from the foregoing, the basic concepts of the present invention may be embodied in a variety of ways. The invention involves numerous and varied embodiments of a portable sign and methods for making and using such a portable sign, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term, "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant(s) should be understood to claim at least: i) each of the portable signs herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A portable sign for removable disposition about a traffic control device, comprising:

a one-piece, laterally continuous sleeve having sleeve outer and inner surfaces, said sleeve inner surface extending between an upper end and a lower aperture defining a sleeve opening configured to removably receive said traffic control device, said lower aperture having a perimeter comprising an arcuate portion and a linear portion;

wherein said sleeve comprises an arcuate lateral portion coupled to a planar lateral portion;

a plurality of flanges coupled to said sleeve proximate the sleeve upper end, wherein said flanges inwardly extend into said sleeve opening defining an upper aperture smaller than the lower aperture;

a panel coupled to said planar lateral portion in overlaying engagement, wherein a panel perimeter of said panel is lesser than a planar lateral portion perimeter of said planar lateral portion; and an information-conveying indicium coupled to said panel, said information-conveying indicium associated with said traffic control device.

2. The portable sign of claim 1, wherein a majority of said panel perimeter of said panel is connected to said sleeve outer surface in overlaying engagement.

3. The portable sign of claim 2, wherein an entirety of said panel perimeter is connected to said sleeve outer surface in overlaying engagement.

4. The portable sign of claim 1, wherein a majority of a panel inner face of said panel is connected to said sleeve outer surface in overlaying engagement.

5. The portable sign of claim 4, wherein an entirety of said panel inner face is connected to said sleeve outer surface in overlaying engagement.

6. The portable sign of claim 1, wherein said portable sign is configured for stackable arrangement.

7. The portable sign of claim 1, wherein said panel is removably coupled to said sleeve in said overlaying engagement.

8. The portable sign of claim 1, wherein upon removable disposition about said traffic control device, said sleeve disposes about a traffic control device bottom portion.

9. The portable sign of claim 1, wherein upon removable disposition about said traffic control device, said sleeve entirely laterally surrounds said traffic control device.

10. The portable sign of claim 1, wherein said sleeve comprises a conical sleeve or a truncated conical sleeve which inwardly tapers toward a sleeve upper end.

11. The portable sign of claim 10, wherein said conical sleeve or said truncated conical sleeve is configured for disposition about a traffic cone.

12. A portable sign for removable disposition about a traffic control device, comprising:

a one-piece sleeve, including:

sleeve outer and inner surfaces, said sleeve inner surface extending between an upper end and a lower aperture defining a sleeve opening configured to removably receive said traffic control device, said lower aperture having a perimeter comprising an arcuate portion and a linear portion;

a plurality of flanges inwardly extending into said sleeve opening proximate the upper end and defining an upper aperture smaller than the lower aperture; and a planar lateral portion; and a panel coupled to said planar lateral portion.

13. The portable sign of claim 12, wherein the panel is coupled to said planar lateral portion in overlaying engagement, wherein a panel perimeter of said panel is lesser than a planar lateral portion perimeter of said planar lateral portion.

14. The portable sign of claim 12, further comprising an information-conveying indicium coupled to said panel, said information-conveying indicium associated with said traffic control device.

15. The portable sign of claim 12, wherein the planar lateral portion further comprises a plurality of slots for receiving portions of the panel therein.

* * * * *